US008066428B2

(12) United States Patent
Behling

(10) Patent No.: US 8,066,428 B2
(45) Date of Patent: Nov. 29, 2011

(54) STOP WATCH INCLUDING A TIME INDICATOR

(75) Inventor: Christoph Behling, London (GB)

(73) Assignee: LVMH Swiss Manufactures SA, La Chaux-de Fonds (CH)

( * ) Notice: Subject to any disclaimer, the term of this patent is extended or adjusted under 35 U.S.C. 154(b) by 88 days.

(21) Appl. No.: 12/019,270

(22) Filed: Jan. 24, 2008

(65) Prior Publication Data

US 2009/0122654 A1 May 14, 2009

Related U.S. Application Data

(63) Continuation of application No. PCT/EP2007/062276, filed on Nov. 13, 2007.

(51) Int. Cl.
*G04F 7/00* (2006.01)

(52) U.S. Cl. ..... 368/102

(58) Field of Classification Search ..... 368/101, 368/102, 110, 113
See application file for complete search history.

(56) References Cited

U.S. PATENT DOCUMENTS

| | | | | |
|---|---|---|---|---|
| 3,077,729 | A * | 2/1963 | Schlenker | 368/228 |
| 5,077,708 | A * | 12/1991 | Schneider | 368/107 |
| 5,195,062 | A * | 3/1993 | Masahiro et al. | 368/21 |
| 6,799,886 | B2 * | 10/2004 | Carrard et al. | 368/281 |
| 6,987,711 | B2 * | 1/2006 | Jolidon | 368/77 |
| 7,134,783 | B2 * | 11/2006 | Schmiedchen et al. | 368/190 |
| 2005/0219959 | A1 * | 10/2005 | Wiederrecht et al. | 368/220 |
| 2006/0039243 | A1 * | 2/2006 | Seyr | 368/227 |

FOREIGN PATENT DOCUMENTS

| | | |
|---|---|---|
| DE | 1673822 | 2/1971 |
| EP | 0365443 | 4/1990 |
| WO | 0159530 A1 | 8/2001 |
| WO | 2004010084 A2 | 1/2004 |

* cited by examiner

*Primary Examiner* — Felix O Figueroa
(74) *Attorney, Agent, or Firm* — Pearne & Gordon LLP

(57) ABSTRACT

A stop watch (1) includes a time indicator comprising a hand (2), a first scale (31) and a second scale (41). A first part of a time indication is shown by the hand (2) on the first scale (31) and a second part of said time indication is shown by said second scale (41) in combination with said first scale (31). The first scale (31) is fixed and said second scale (41) is movably mounted around said first scale (31). The first part of said time indication corresponds to seconds of a duration counted by said stop watch (1), and the second part of said time indication corresponds to tenths of seconds of said duration.

22 Claims, 3 Drawing Sheets

STOP WATCH INCLUDING A TIME INDICATOR

RELATED APPLICATIONS

The present application is a continuation of international application 2007WO-EP062276 filed Nov. 13, 2007, the content of which is included by reference.

FIELD OF THE INVENTION

The present invention concerns a stop watch including a time indicator according to the independent claim.

DESCRIPTION OF RELATED ART

Common stop-watches comprise a rotating hand and a scale on the dial, or on a small dial, for indicating the seconds of the duration counted by the watch. Although the tenths of seconds of this duration may be guessed by checking the position of the hand between two marks of the scale, this conventional arrangement does not allow a precise, fast or convenient reading of fractions of seconds.

DE 1 673 822 concerns a time indicator of a stop watch in which a rotating hand is mounted centrally in a watch. The hand interacts with a scale on the watch to indicate the seconds. The hand includes a second scale which as well interacts with the scale on the watch to indicate the tenth of seconds. The hand therefore has a scale or indents, which are mounted on a segment on the upper end of the hand.

WO-A1-01/59530 concerns a timekeeping clock wherein on the axis of a mobile counter completing a cycle in 11 seconds is mounted a transparent disc bearing radial markers. The dial positioned beneath the disc provides a marking in the form of a marker circle with radial markers numbered 0, 1, 2, 3, 4, 5, 6, 7, 8 and 9. At each step of the mobile disc successive alignments occur between a marker of the disc and a marker of the ring thereby enabling tenths of seconds elapsed to be displayed anticlockwise.

WO-A2-2004/010084 relates to a position indicator for indicating the relative position of two components which can be displaced in relation to each other. A first indicator pattern is applied to the first of the two components in a fixed manner, and a second indicator pattern is applied to the second of the two components in a fixed manner. The first indicator pattern extends in an extension direction over a first length L1 and consists of a number N1 of essentially identical first partial patterns which periodically repeat in the extension direction. The second indicator pattern extends in an extension direction over a second length L2 and consists of a number N2 of essentially identical second partial patterns which periodically repeat in the extension direction. According to the disclosure, the following equations hold true: $L2=L1*(1+/-1/N1)$ and $N2=N1/n$ or $L2=L1$ and $N2=N1/n+/-1$. It is characterised in that the first and/or second partial patterns have other indicator characteristics, enabling the relative position to be read more accurately, according to the accuracy of a vernier scale with an $(N1/n)-1$ to $N1/n$ graduation. However, this watch cannot be used as a timekeeping watch.

EP-A2-0 365 443 relates to a method which, when used on an analog watch, permits timings of a duration of twelve hours, with a reading accuracy equal to one minute. It consists of a watch of circular form, equipped with an adjustable ring and a disc, performing one revolution per hour, and bearing the customary marks (full minute and hour scales). The scale of the ring is produced by marking a first portion equal to the angular value of an hour division of the disc, the remainder of the circumference in twelve equal portions, these being subdivided into five. The system is particularly intended for the display of information on time and chronographic instruments. However, it does not disclose the indication of tenth of seconds.

BRIEF SUMMARY OF THE INVENTION

One aim of the present invention is to provide a time indicator of a stop watch which can indicate the tenth of seconds.

Another aim of the present invention is to provide a time indicator of a stop watch which indicates the tenth of seconds by a vernier.

According to the invention, these aims are achieved by means of the independent claim.

In particular, the aims are solved by a stop watch including a time indicator comprising a hand, a first scale and a second scale, whereby a first part of a time indication is shown by the hand on the first scale and a second part of said time indication is shown by the second scale in combination with the first scale, wherein said first scale is fixed and said second scale is movably mounted relatively to the first scale.

These aims are also solved by a vernier-type indicator in which the graduation of the seconds on the dial corresponds to a graduation on an outer rotating ring.

The first part of a time indication can be an indication of seconds and the second part of a time indication is an indication of tenth of seconds. With the same principle the first part of a time indication could be an indication of tenth of seconds and the second part of a time indication is an indication of hundredth of seconds.

While the first scale can be mounted on a fixed dial, the second scale in combination with said first scale is a rotating ring mounted around said disc and both work together as a vernier. The hand can be movable or rotatable around a central axis together with said second scale on said ring. Said rotating ring can be a bezel above or around said dial.

The advantage lies in that the hand and dial need not to be changed in respect to existent dials and the dial remains easy to read. Modifications are brought to the bezel only. Another advantage is that the user only has to use the second time indicator when he wants to know exactly the tenth of seconds of an elapsed time.

The second scale can be moved manually or automatically around said first scale to read the mentioned second part of said time indication. This can be done by a crown or button mounted at 10 o'clock at a casing of said stop watch. Said second scale or ring can be driven by a toothed wheel and gears.

Advantageous embodiments are described in the dependent claims.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
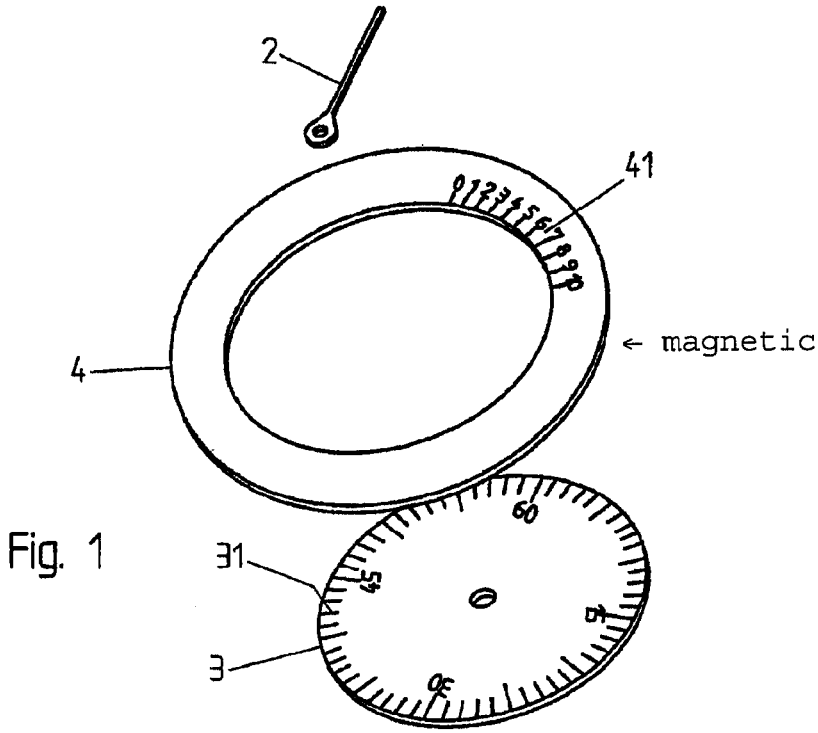
FIG. 1 shows an exploded view of the different parts of the time indicator according to the present invention.

FIG. 1 shows an exploded view of the different parts of the time indicator of a timekeeping or stop watch 1 according to the present invention. The central second hand 2 is mounted on a central axis through the dial 3. For indication of the seconds, the dial 3 bears a first time indicator scale 31 comprising marks on the dial 3, for example 60 marks equally spaced at the periphery of the dial and corresponding to the seconds/minutes of the current time. The first part of an elapsed time measured by the stop watch 1 is indicated by the hand 2 in combination with the first scale 31. In the embodiment shown, the first scale 31 is written around the dial 3 from one to 60, with regular spaced markers. In this way the first scale 31 in combination with the hand 2 can indicate the seconds of the elapsed time. The same scale can be used for reading the seconds and/or minutes of the current time.

In addition there is an outer ring 4 or bezel which is arranged above and/or around the dial 3. The ring 4 bears preferably only a segment of the whole circle along the edge markers indicating numbers from 0 to 10. The scale 41 so formed is marked next to the inner edge of the ring 4. The second scale 41 can in that way in combination with said first scale indicate a second part of elapsed time, e.g. the tenth or hundredths of seconds of the elapsed time as explained in detail below in form of a vernier or vernier calliper.

Figure 2:
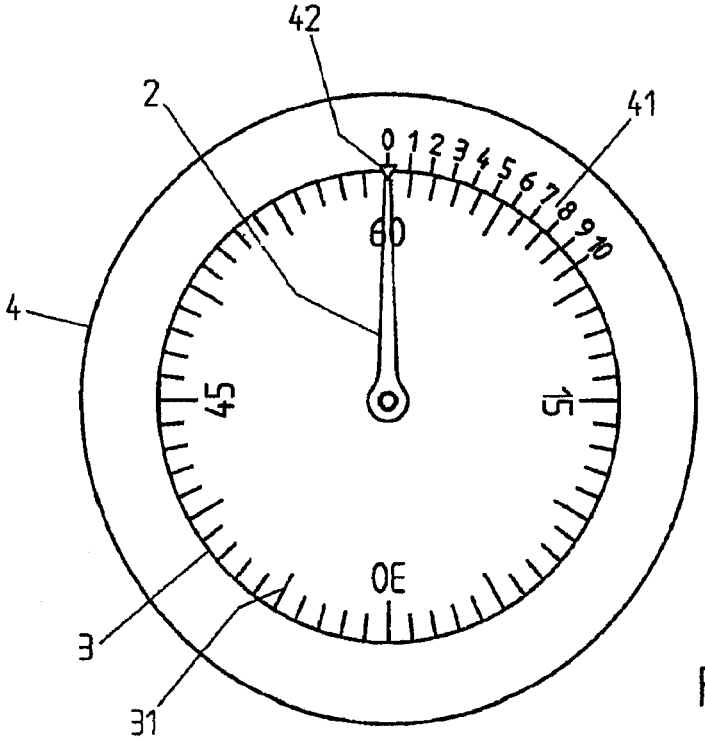
FIG. 2 shows a view of the assembled parts as shown in FIG. 1.

The vernier illustrated on the figures thus comprises a first scale 31 and a second scale 41 arranged so that 11 marks of the scale 41 occupy the same circular length than 10 marks of the scale 31, as best seen on FIG. 2. If the first marks (0 of scale 41 and 60 of scale 31) of both scales are aligned, the angular shift between the next successive marks is thus increased at each mark by one tenth of second. For example, the angular distance between the first pair of marks on both scales and the third following pairs of marks corresponds to $3/10^{th}$ of second.

Other arrangements of verniers are possible, including verniers with other numbers of marks on each scale, or verniers having marks disposed in closer vicinity on the first scale than on the second scale.

FIG. 2 shows a view of the assembled parts as shown in FIG. 1 in a starting or in a position after resetting the timekeeping watch. Therefore the hand 2, the 60 or zero of the scale 31 and the 0 of the scale 41 are aligned in an upper high noon position. To increase legibility of the seconds, the ring 4 bears a mark in combination with the marker zero, such as a triangle 42, and so making it easier for the user to read the elapsed time.

Figure 3:
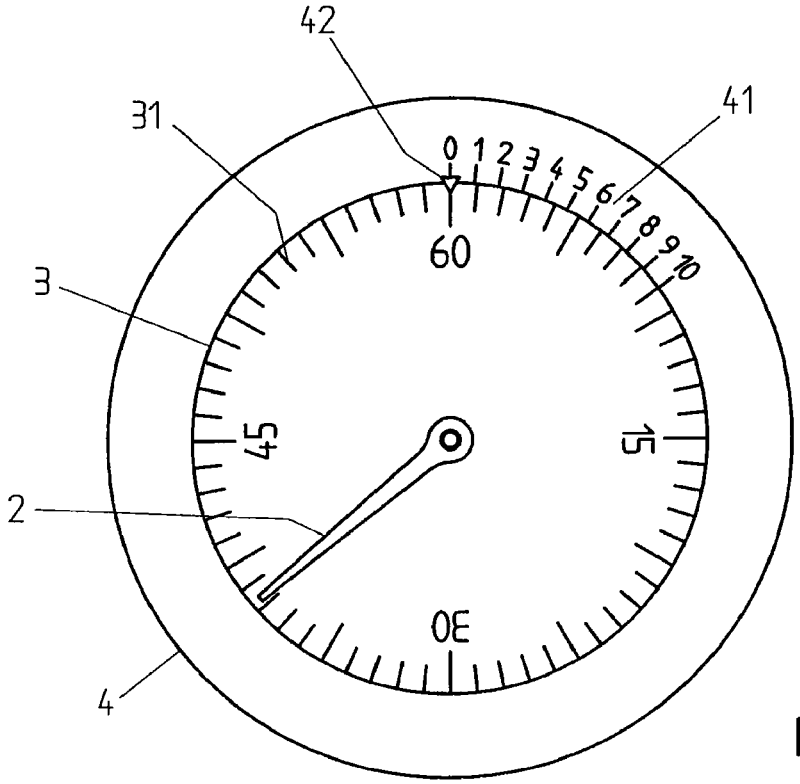
FIG. 3 shows a view of the stop watch after an elapsed time of 38.3 seconds.

FIG. 3 shows a view of the stop watch after an elapsed time of 38.3 seconds. However, in this embodiment, only the hand 2 moved, while the ring 4 stayed in his 12'oclock position during the duration counted by said hand 2. In order to know the tenth of seconds of the elapsed time, the user will move the ring 4 to the position seen in FIG. 4, using a second crown discussed later. While the inner dial 3 and the hand 2 are fixed, the outer ring 4 is turned until the mark 42 is aligned with hand 2 around the dial 3.

Figure 4:
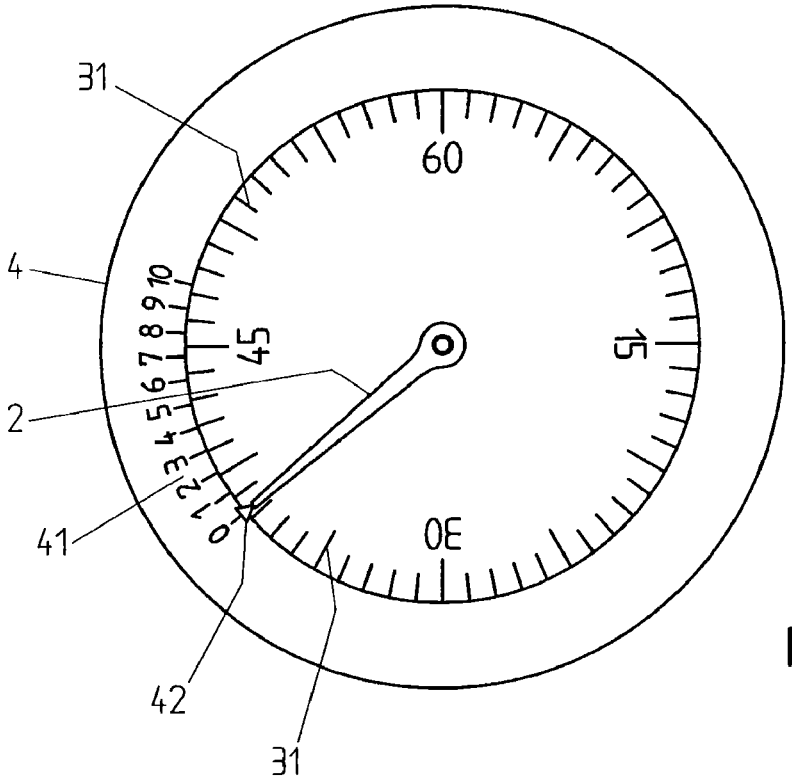
FIG. 4 shows a view of the stop watch after an elapsed time of 38.3 seconds measuring the tenth of second of the elapsed time.

The user can then read the seconds as well as the tenth of the seconds as follows: the hand 2 shows in combination with the first scale 31 the elapsed seconds or a first part of a time indication. Since the hand 2 can be between two full seconds, the user can use the second scale 41 in combination with said first indicator time scale 31 to read the tenth of seconds or a second part of a time indication. When the mark 42 is aligned to hand 2, the graduation of the scale 41 which is aligned with the graduation of the scale 31 gives the tenth of second, in the given example it is 3, which means the 3/10 of second in addition to the 38 second indicated with hand 2. This situation is shown by FIG. 4.

Figure 5:
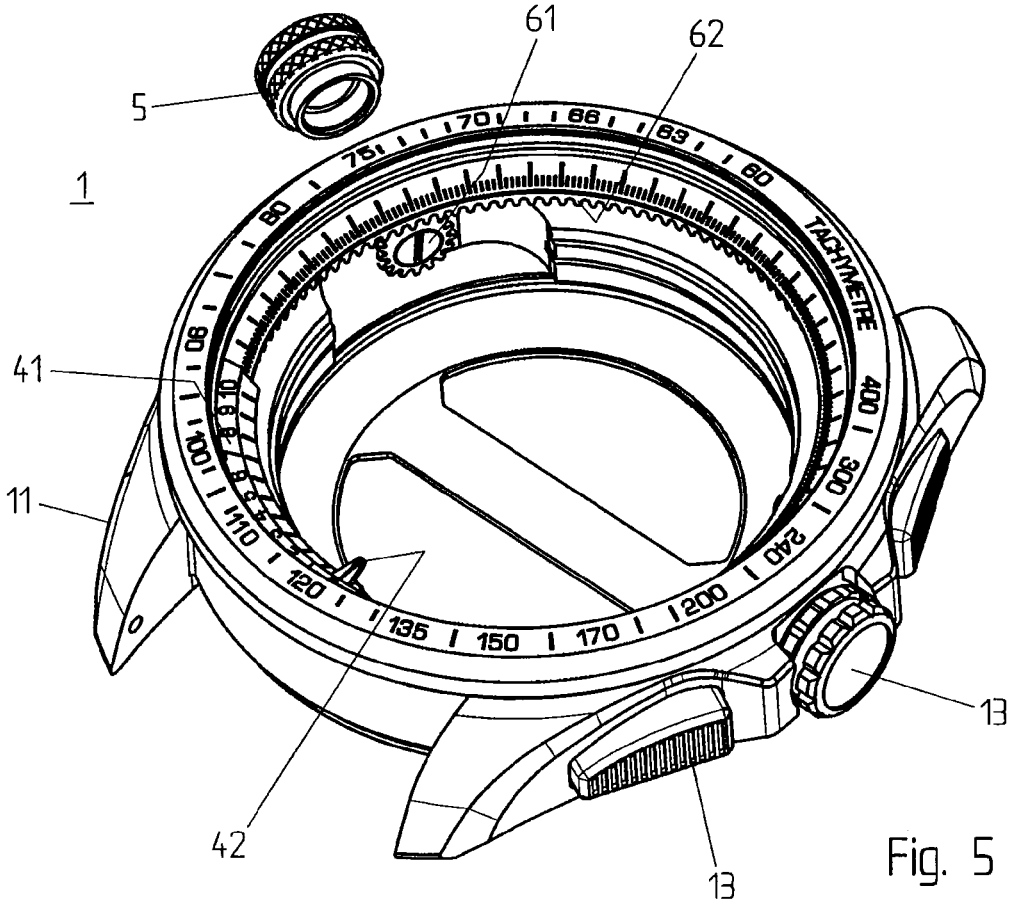
FIG. 5 shows the appearance of the stop watch according to the invention.
Figure 6:
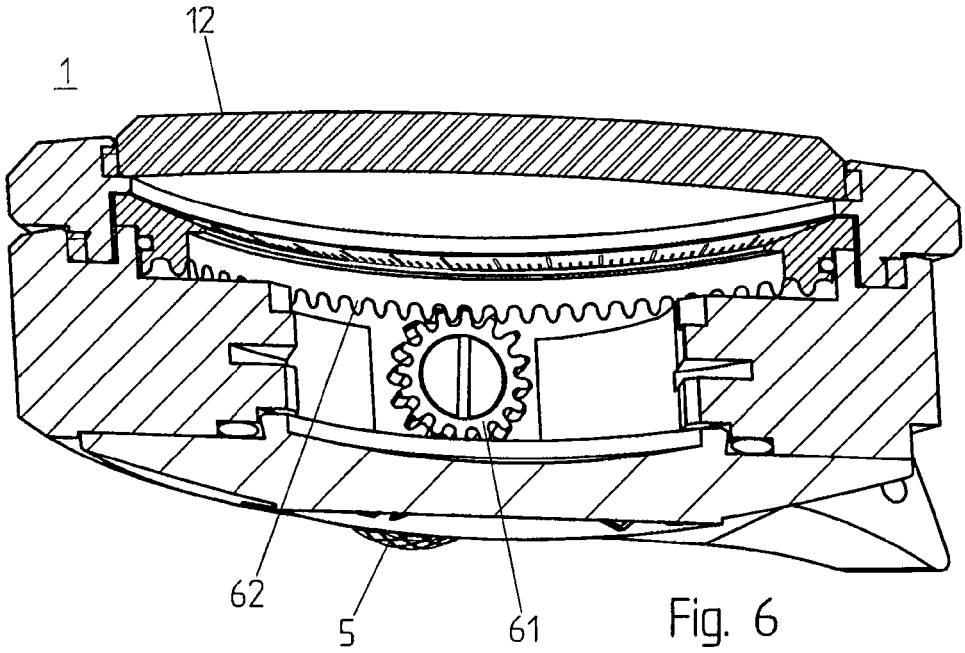
FIG. 6 shows a perspective cut through the stop watch according to FIG. 5.

FIG. 5 shows the appearance of the casing 11 of the stop watch 1 according to the invention and FIG. 6 shows a cut through this casing. Apart from this casing 11, the stop watch 1 also comprises a glass 12 and button and/or crowns 13. The button and/or crown 13 will be provided to allow the user to use the normal functions of the watch such a time setting, rewinding and the measurement of a duration counted by said stop watch and resetting the stop watch 1. In the given example, the buttons 13 above and below the crown could be used as for the START, STOP and RESET Function of the stop watch 1 and other additional functions of the watch. The watch could use a mechanical movement or an electronic step motor.

FIG. 6 shows a perspective cut through the mechanism to drive the outer ring 4. This can be done by a crown 5, which drives a pinion 61. In the given example the crown 5 is mounted at a 10 o'clock position on the casing 11 of the stop watch 1. It could be, however, at any position of the casing 11. The pinion 61 drives teeth 62 or inner toothing below the ring 4. Preferably the ring 4 might be moved manually be the user, using the additional crown 5 or, in a various embodiment, an additional axial position of the crown 13. It would be, of course possible, that the ring 4 might be turned automatically using an independent motor. In order to make sure that the outer ring 4 remains precisely at the desired place and does not move despite a possible play between teeth, a holding spring (not shown) can be used.

In a various, not illustrated embodiment, the outer ring 4 may be driven by a magnetic system, for example using magnets fixed to the ring 4 and cooperating with magnets fixed to an external part outside of the watch casing, for example on a rotating bezel as described in International Application WO0244818 whose content is included by reference. The outer ring 4 can thus be driven in rotation by the attraction between portion of magnetic material of the bezel and magnetic portion of the ring 4.

As described, the ring 4 is preferably moved manually by the user after the STOP button has been pushed, so as to align the mark 42 with hand 2. In a various embodiment, the ring 4 could be driven by the watch movement, for example by the second wheel that drives the second hand 2. In this case, the ring 4 can be driven as soon as the START button is pushed together with hand 2 or only when the STOP button has been pushed. It is also possible to drive the outer ring with an electric stop motor, during or after the rotation of the second hand 2.

The outer ring 4 may be flat in the plane of the dial 3 or preferably built as a flange.

The principle mentioned above regarding the measuring of time could be made in the same way by using a small dial or indication within the dial 3 with a small, not centred second hand (not shown). The ring 4 would in this case be mounted around the small dial with the second scale, which would form the vernier together with the first scale. The small hand would indicate together with the first scale the mentioned first part of the time indication.

With the same principle explained in the application, the first part of a time indication could be an indication of tenth of seconds and the second part of a time indication is an indication of hundredth of seconds.

An advantage of the invention lies in that the hand 2 and dial 3 have not to be changed in respect to existent dials and the dial remains easy to read. Modifications are brought to the bezel or ring 4 only. Another advantage is that the user does not have to use the second time indicator, but only when he wants to know exactly the tenth of seconds.

REFERENCE NUMBERS

1 Stop watch
11 Casing of stop watch 1
12 Glass of stop watch 1
13 Button and/or crown of stop watch 1
2 Central hand for counting seconds
3 Dial
31 First scale—for the seconds on dial 2
4 Outer Ring
41 Rotatable second scale—for tenth of seconds on the outer ring 3
42 Mark, for example triangle
5 Crown
61 Pinion
62 Teeth below ring 4

The invention claimed is:

1. Stop watch including:
a casing,
a hand,
a first scale,
a second scale,
whereby a first part of a time indication is shown by the hand on the first scale,
whereby a second part of said time indication is shown by the second scale in combination with the first scale,
wherein the first scale is fixed and the second scale is movably mounted relatively to the first scale to read the second part of said time indication and wherein said second scale includes marks on a rotation ring mounted around the first scale.

2. The stop watch of claim 1, wherein the first part of said time indication corresponds to seconds of a duration counted by said stop watch, and the second part of said time indication corresponds to tenths of seconds of said duration.

3. The stop watch of claim 1, wherein said first scale includes marks on a fixed dial of said stop watch.

4. The stop watch of claim 1, wherein said second scale in combination with said first scale is a vernier.

5. The stop watch of claim 1, wherein the hand is movably mounted relative to the second scale.

6. The stop watch of claim 3, wherein said second scale comprises eleven marks which occupy a same length than ten said marks of said first scale.

7. The stop watch of claim 1, said rotating ring being a bezel or flange.

8. The stop watch of claim 1, wherein said hand and said second scale rotate around a central axis.

9. The stop watch of claim 1, wherein said second scale is movable manually around said first scale to read the second part of said time indication.

10. The stop watch of claim 1, wherein said second scale is automatically driven around said first scale to read the second part of said time indication.

11. The stop watch of claim 1, wherein said second scale is manually movable by a crown or button on said casing of said stop watch.

12. The stop watch of claim 1, wherein said second scale is manually movable using a magnetic interaction of a magnetic bezel outside of said casing.

13. The stop watch of claim 1, wherein the rotation of said second scale is done during counting of the time indication by said hand or only after a stop button is pressed.

14. The stop watch of claim 1, said second scale comprising an additional mark in combination with a marker zero.

15. The stop watch of claim 1, wherein the stop watch comprises a mechanical movement.

16. The stop watch of claim 1, wherein the stop watch comprises at least one step motor for driving said hand.

17. The stop watch of claim 14, wherein the marker zero is a triangle.

18. The stop watch of claim 1, wherein the second part is a sub-unit of the first part.

19. Stop watch including:
a casing,
a hand,
a first scale,
a second scale,
whereby a first part of a time indication is shown by the hand on the first scale,
whereby a second part of said time indication is shown by the second scale in combination with the first scale,
wherein the first scale is fixed and the second scale is movably mounted relatively to the first scale to read the second part of said time indication,
wherein the first part of said time indication corresponds to seconds of a duration counted by said stop watch, and the second part of said time indication corresponds to tenths of seconds of said duration, and
wherein said second scale includes marks on a rotation ring mounted around the first scale.

20. The stop watch of claim 19, wherein the hand is movably mounted relative to the second scale.

21. Stop watch including:
a casing,
a hand,
a first scale,
a second scale,
whereby a first part of a time indication is shown by the hand on the first scale,
whereby a second part of said time indication is shown by the second scale in combination with the first scale,
wherein the first scale is fixed and the second scale is movably mounted relatively to the first scale,
wherein said second scale is movable manually around said first scale to read the second part of said time indication, and
wherein the second scale includes marks on a rotation ring mounted around the first scale.

22. The stop watch of claim 21, wherein the hand is movably mounted relative to the second scale.

* * * * *